US005433661A

United States Patent [19]

Kim

[11] Patent Number: 5,433,661

[45] Date of Patent: Jul. 18, 1995

[54] AIR FLOW DIRECTION ADJUSTING APPARATUS

[75] Inventor: Wan S. Kim, Kyungki-Do, Rep. of Korea

[73] Assignee: Samsung Electronics Co., Ltd., Suwon-City, Rep. of Korea

[21] Appl. No.: 978,498

[22] Filed: Nov. 18, 1992

[30] Foreign Application Priority Data

Dec. 30, 1991 [KR] Rep. of Korea ..... 91-25042

[51] Int. Cl.[6] ..... F24F 13/14

[52] U.S. Cl. ..... 454/285; 454/202

[58] Field of Search ..... 454/153, 202, 285, 313, 454/316, 321

[56] References Cited

U.S. PATENT DOCUMENTS 3,333,522 8/1967 Fadow ..... 454/153

4,018,159 4/1977 Bennett ..... 454/285

4,365,930 12/1982 Ogura et al. ..... 454/313 X

FOREIGN PATENT DOCUMENTS 148132 9/1982 Japan ..... 454/153

*Primary Examiner*—Harold Joyce

*Attorney, Agent, or Firm*—Burns, Doane, Swecker & Mathis

[57] ABSTRACT

An air conditioner has a flow directing vent comprised of slanted vanes. The vent is driven by a drive mechanism which oscillates the vent about an axis. The drive mechanism includes a motor driven shaft which rotates continuously in one direction, and a mechanism for converting such continuous rotation into oscillation of the vent. The drive connection between the vent and drive mechanism can be manually disconnected by axial displacement of the vent, to enable the rotational position of the vent to be adjusted relative to the drive mechanism.

5 Claims, 5 Drawing Sheets

AIR FLOW DIRECTION ADJUSTING APPARATUS

BACKGROUND OF THE INVENTION

The invention relates to an air flow direction adjusting apparatus of a single unit air-conditioner.

In most cases, the conventional air flow direction adjusting apparatus of an air conditioner comprises a plurality of vertical air flow direction plates mounted at one end of an outlet vent which automatically directs the air flow direction to the right side or the left side of the outlet vent. Further, at the rear of the vertical air flow direction plates a plurality of horizontal air flow direction plates are mounted for the manual adjustment of the air flow direction towards the upper side or the lower side of the outlet vent.

However, in the above conventional apparatus, if a single motor is employed, the air flow is directed to only the right side or to the left side depending on the setting of the automatic air flow directional adjustment. In the event that an automatic succession of adjustments of the air flow direction toward the upper, lower, right and left side is required, the above apparatus has the problem that more than one motor is required. Further, the range of air flow adjustments of the discharged air is limited to four directions; the upper, lower, right, and left side. Thus, the air flow is repeatedly directed to one limited place. That creates another problem in that it requires a long time to reach the desired level of air conditioning. Excessive electric power consumption is necessitated, and the efficiency of the air conditioning is decreased.

SUMMARY OF THE INVENTION

The present invention has been made in consideration of the prior art.

One object of the invention is to provide an air flow direction adjusting apparatus which achieves the maximum efficiency of the air flow so that the various directions of the air flow are repeatedly changed and then returned to the starting point, i.e. a predetermined point, in order to achieve an even distribution of the air.

Another object of the invention is to provide an air flow direction adjusting apparatus which can adjust the air flow in a full circular range direction by a single adjusting apparatus.

According to an aspect of the present invention, the air flow direction adjusting apparatus of the present invention includes an air outlet vent having a plurality of slanted air flow direction plates for directing the air flow, a support means provided adjacent to the rear surface of the outlet vent for facilitating the rotational movement and the forward or backward movement of the outlet vent, and a clockwise rotational power transmission means for driving the outlet vent in a continuous clockwise or counter clockwise direction.

Further, the outlet vent comprises a rim that houses the air flow direction plate. The rim provides first and second coaxial driven members which have different diameters.

Further, the power transmission means comprises a first and a second driving member which rotate in the same direction, and an intermediate power transmitter which engages with either the first driven member or the second driven member and the first driving member or the second driving member for rotating the rim in the opposite rotational direction of the power driving member.

Further, the first and the second power driving members on the same driving shaft provide, respectively, the first driving member drives the vent when the second driving member does not drive the vent, and the second driving member drives the vent when the first driving member does not drive the vent.

Furthermore, the intermediate power transmitter comprises a pinion.

DESCRIPTION OF THE PREFERRED EMBODIMENT

Figure 1:
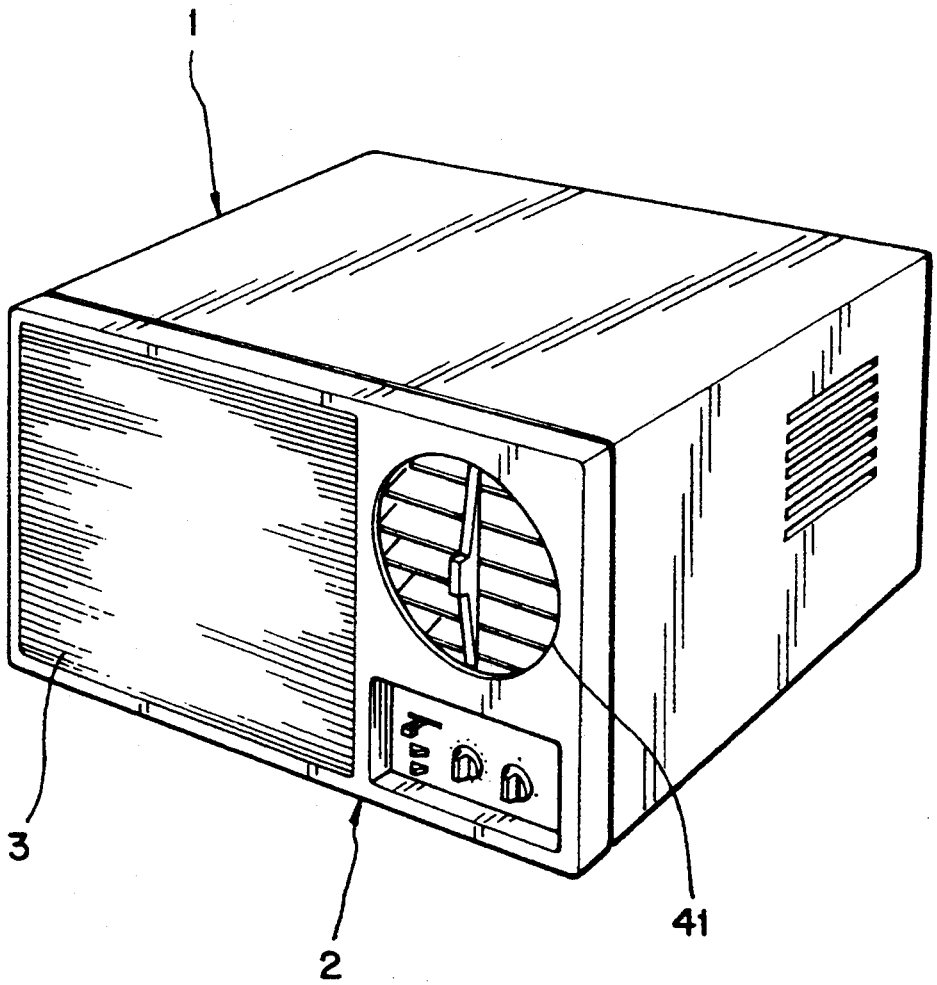
FIG. 1 is a schematic view of an air conditioner having the air flow direction adjusting apparatus of the present invention.

In FIG. 1, a single unit air conditioner comprises a body 1 housing an indoor heat exchanger and an outdoor heat exchanger which are not shown. In the front of the indoor heat exchanger a front cover 2 is provided which is constructed of an inlet vent 3 and an outlet vent 41 which constitute an air flow direction adjusting apparatus of the present invention. The size of the inlet vent 3 is formed to be approximately the same as that of the indoor heat exchanger. Adjacent to the inner rear surface of the indoor heat exchanger, a fan (not shown) is installed. The fan draws indoor air through the inlet vent 3 and discharges the heat exchanged air through the outlet vent 41 toward the area to be air-conditioned.

Figure 2:
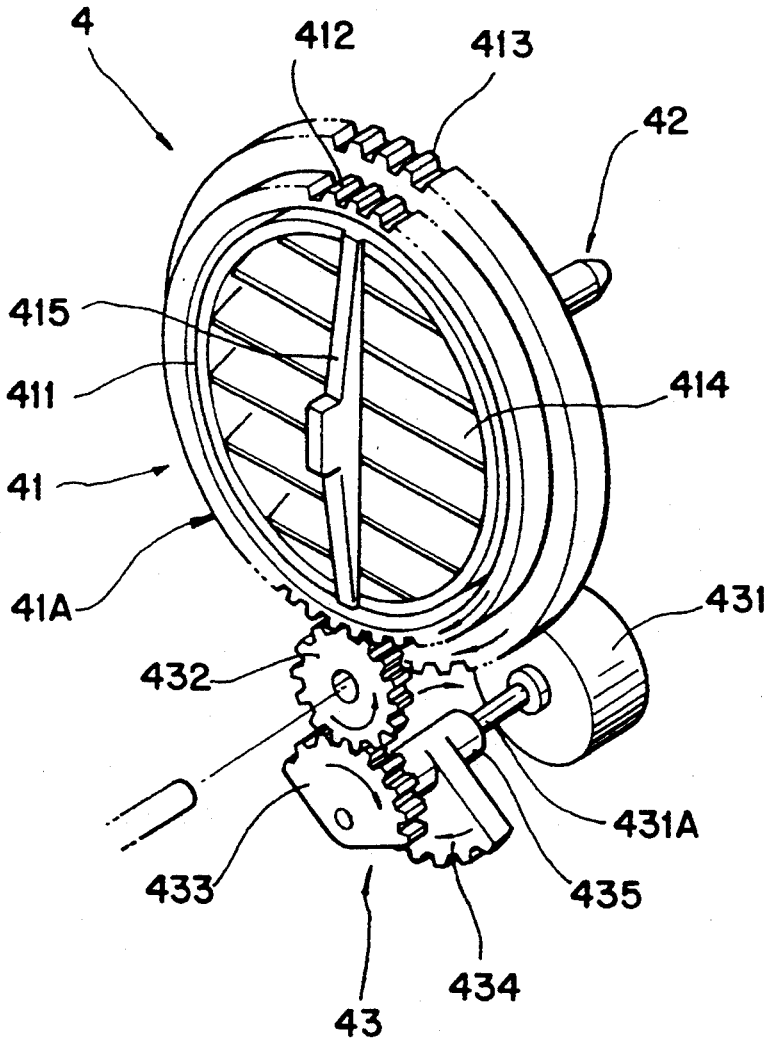
FIG. 2 is a schematic perspective view of the air flow direction adjusting apparatus.
Figure 3:
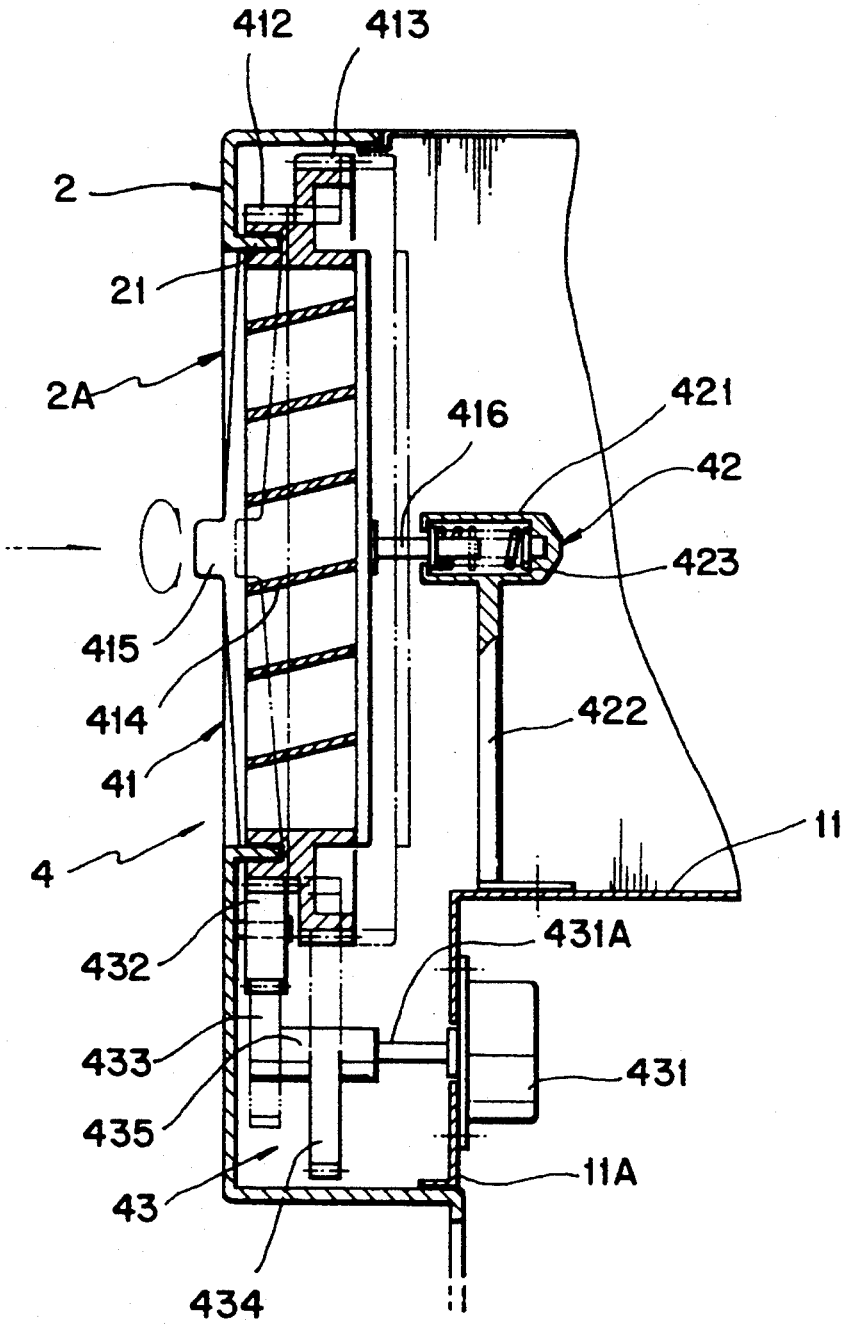
FIG. 3 is a partial longitudinal sectional view of an air conditioner having the air flow direction adjusting apparatus.

In FIGS. 2 and 3, the air flow direction adjusting apparatus 4 comprises the outlet vent 41 provided at the inner rear surface of the front cover 2 which can rotate in a full 360 degree circle, a support means 42 provided adjacent to the inner rear surface of the outlet vent 41 for accommodating forward and backward movements of the outlet vent 41 as well as the rotation thereof, and a power transmission means 43 for rotating the outlet vent 41 in either a clockwise or a counterclockwise direction, or alternatively, within a predetermined arc degree.

The outlet vent 41 provides a circular body 41A comprising a first driven gear 412 and a second driven gear 413 which are coaxial with the rim. The diameter of the first driven gear 412 is smaller than that of the second driven gear 413. Along the front of the circumference of the first driven gear 412 a circular groove 411 is provided which is engaged slidingly with a circular projecting part 21. The projecting part 21 is located at the edge of the opening 2A which is formed at the front cover 2. The projecting part 21 serves as a guide track to enable the outlet vent 41 to rotate and also to freely move forward and backward. At the center portion of the rim 41A, a plurality of slanted air flow directional vanes or plates 414 are located and positioned in one direction. Across the middle front edge of each directional plate 414 a knob 415 is attached for adjusting the air flow direction. A rotation rod 416 is attached to the rear surface of the outlet vent 41 along the central axis thereof. Along the outer circumference of the first driven gear 412 and that of the second driven gear 413 cogs (gear tooth) for more effective power transmission are provided.

The support means 42 is provided with a support cap 421 and a support rod 422 formed integrally with the body of the support cap 421. The support cap 421 has a hollow body with one end opened, in which the rotation rod 416 of the outlet vent 41 is inserted in a coaxial manner. In the hollow body of the support cap 421, a spring 423 is positioned so as to continuously push the rotation rod 416 forward toward the front cover 2. The support rod 422 is mounted detachably on the horizontal bracket 11.

The power transmission means 43 has a driving motor 431 which is mounted detachably on a vertical wall 11A which extends at an angle from a bracket 11. A rotation shaft 431A of the motor 431 extends forward, on which the hub 435 is located. Along the outer surface of the hub 435 two driving gears are formed to comprise a first fan shaped gear 433 and a second fan shaped gear 434, located a predetermined distance from each other. The second gear 434 directly engages with the second driven gear 413 while the first gear 433 indirectly engages with the first driven gear 412. The means for employing the indirect engagement is a pinion 432, which is mounted on the lower rear face of the front cover 2 by shaft 432A. The arc of the first driving gear 433 is located in the opposite direction of the arc of the second driving gear 434 as shown in FIG. 2, i.e., the arcs of the gears 433, 434 are offset by 180 degrees relative to each other. The first driving gear 433 comes into contact with the first driven body 412 while the second driving gear 434 is not in contact with the second driven gear 413, and vice versa.

According to the above structure, the air flow direction in respect to the air flow direction plate 414 of the outlet vent 41 is achieved because the outlet vent 41 can be adjusted toward the place the air is desired. In FIG. 3, the knob 415 is pushed as shown in a dotted line and the rotation shaft 416 compresses the spring 415 in the support cap 421, and thus the first driven gear 412 disengages from the pinion 432. In this condition, the user can rotate the outlet vent 41 to an any desired position and the air flow direction can thus be adjusted so as to direct the air where it is needed. After the air flow direction is determined, the outlet vent 41 is repositioned due to the force of the spring 423 such that the first driven gear 412 engages with the pinion 432.

Figure 4:
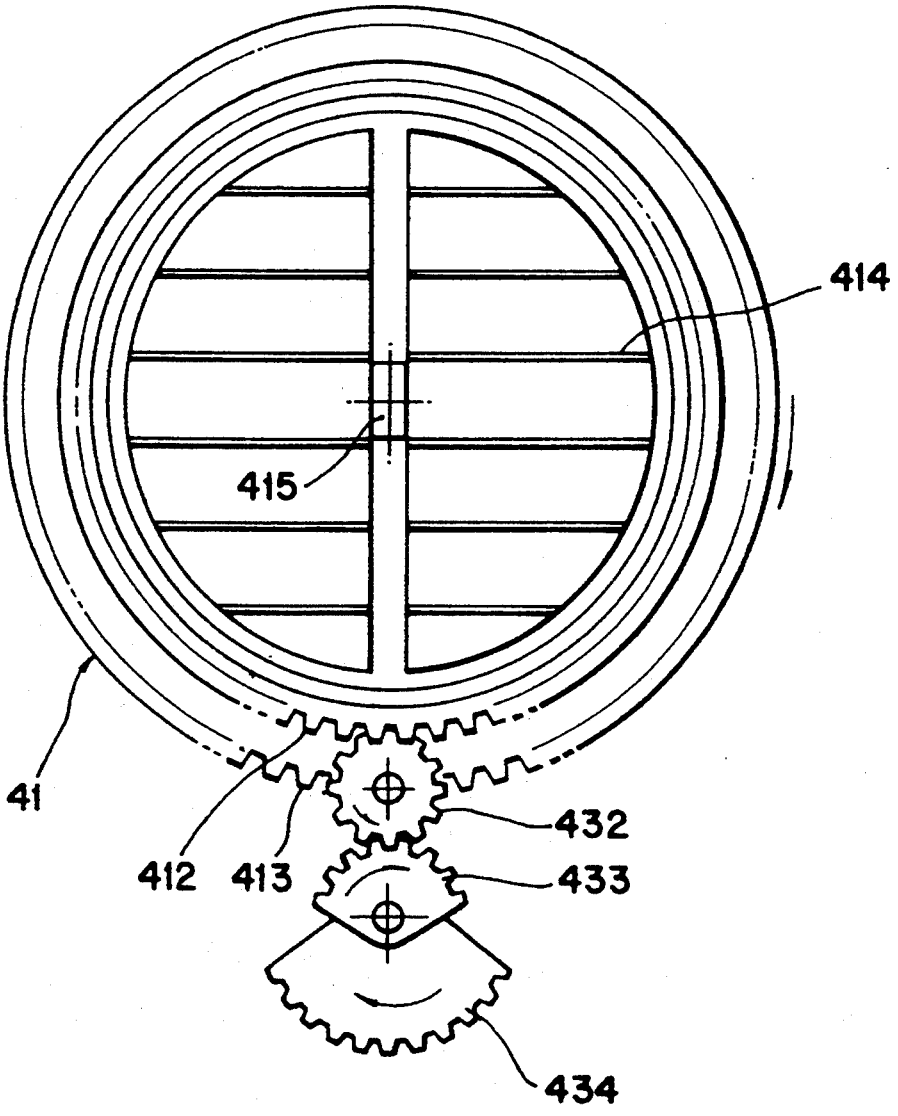
FIG. 4 is a front elevational view of the air flow direction adjusting apparatus in a clockwise rotation.
Figure 5:
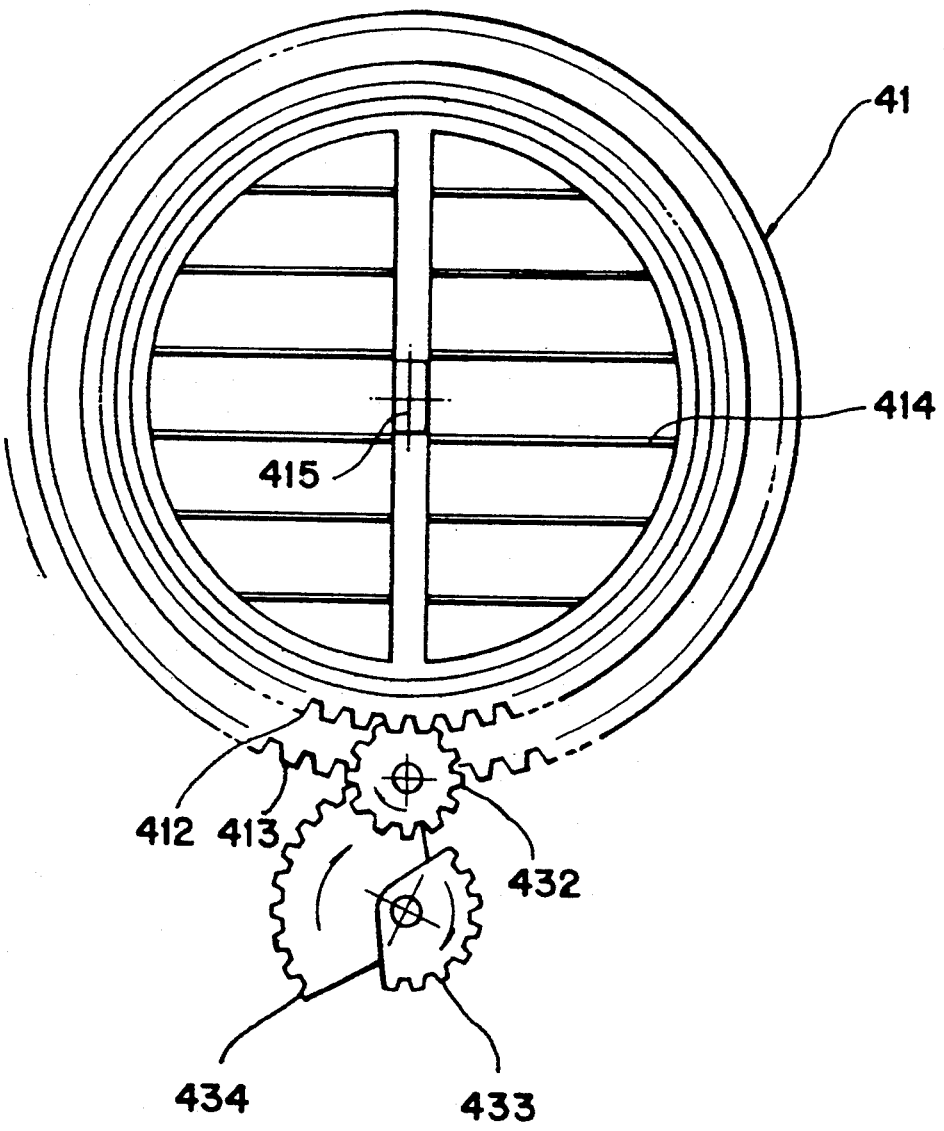
FIG. 5 is a front elevational view of the air flow direction adjusting apparatus in a counterclockwise rotation.

When the first driving gear 433 engages with the first driven gear 412 via the pinion 432, and as motor 431 operates, the rotation shaft 431A rotates in a clockwise direction as shown in FIG. 4. The first driven gear 412 moves in a clockwise direction and the outlet vent also rotates in a clockwise direction within a contacting range of the first driving gear 433. After the first driving gear 433 and the pinion 432 become disengaged, the second driving gear 434 starts to engage with the second driven gear 413 of the outlet vent 41 as shown in FIG. 5. As the rotation shaft 431A rotates in a clockwise direction such that the second driving gear 434 moves in the same direction, the second driven gear 413 moves in a counterclockwise direction. After the second driving gear 434 and the second driven gear 413 become disengaged, the first driving gear 433 starts to reengage with the first driven gear 433 via the pinion 432 as shown in FIG. 4.

As the clockwise and counterclockwise direction of the outlet vent is repeatedly performed as described above, the body 41 oscillates back and forth about the axis of the rod 416 and the heat-exchanged air is directed to the place as determined by the user. The present invention thereby saves energy due to the minimum time required of the air conditioning operation, and also due to the greater efficiency of the air condition operations.

The present invention is not restricted to the above embodiment, but the present invention can also be such that the pinion is located between the second driving gear and the second driven gear.

What is claimed:

1. In an air conditioner, an air flow directing device comprising:

a rotary body having slanted air directing vanes, said body being mounted for rotation about an axis of rotation, and a power-driven drive mechanism for oscillating said body about said axis within a range of rotary movement, said drive mechanism including a motor-driven shaft rotatable continuously in one direction, and first and second drive trains interconnecting said shaft with said rotary body for rotating said rotary body in opposite first and second directions, respectively, each of said first and second drive trains being defined by a series of intermeshing sets of gear teeth including an initial set and a final set, said gear teeth of both of said initial sets being fixed for common rotation With said shaft and extending for an angular distance no greater than 180 degrees, both of said final sets being fixed for common rotation with said rotary body;

said initial set of said first drive train being axially offset with respect to said initial set of said second drive train;

said initial set of said first drive train being angularly offset with respect to said initial set of said second drive train, such that said initial set of said first drive train transmits rotary drive from said shaft to said rotary body in alternating relationship with respect to said initial set of said second drive train as said shaft rotates in said one direction;

said series of gear teeth sets of one of said first and second drive trains being defined by an odd number of gear teeth sets, and said series of gear teeth sets of the other of said first and second drive trains being defined by an even number of gear teeth sets, so that said rotary body travels in opposite directions when driven by said first and second gear trains, respectively.

2. Apparatus according to claim 1, wherein said body is movable axially along said axis of rotation relative to said drive mechanism for disconnecting said body from said first and second drive trains to enable said body to be rotated relative to said drive means for adjusting the pattern of oscillation.

3. Apparatus according to claim 2 including biasing means for biasing said body to a position wherein said body is connected to said drive trains.

4. In an air conditioner, an air flow directing device comprising:

a rotary body having slanted air directing vanes, said body being mounted on an axle for rotation about an axis of rotation, and power-driven drive means for oscillating said body about said axis within a range of rotary movement, said drive means including a motor-driven shaft rotatable continuously in one direction, first and second drive gears fixed for common rotation with said shaft and disposed in axially spaced relationship along said shaft, each of said first and second drive gears including gear teeth extending around an outer periphery thereof for an angular distance less than 180 degrees, first and second driven sets of gear teeth being fixed for common rotation with said rotary body, said first driven set being axially spaced from said second driven set along said axis of rotation, a pinion arranged to transmit rotary drive from said first drive gear to said first driven set, said second drive gear arranged to transmit rotary drive directly to said second driven set, so that rotary drive transmitted from said shaft to said first driven set rotates said rotary body in a first direction, and rotary drive transmitted from said shaft to said second driven set rotates said rotary body in a second direction opposite said first direction, said gear teeth of said first drive gear being angularly offset with respect to said gear teeth of said second drive gear such that said first and second drive gears alternately transmit rotary drive from said shaft to said rotary body.

5. Apparatus according to claim 4 including means for disconnecting said connection between said body and said first and second drive gears to enable said body to be rotatably adjusted relative to both said first and second drive gears.

* * * * *